US009308925B2

(12) United States Patent
Cooper et al.

(10) Patent No.: US 9,308,925 B2
(45) Date of Patent: Apr. 12, 2016

(54) SYSTEM AND METHOD FOR INSPECTION OF WAYSIDE RAIL EQUIPMENT

(71) Applicant: GENERAL ELECTRIC COMPANY, Schenectady, NY (US)

(72) Inventors: Jared Klineman Cooper, Melbourne, FL (US); Nicholas David Nagrodsky, Melbourne, FL (US); Joseph Forrest Noffsinger, Grain Valley, MO (US)

(73) Assignee: General Electric Company, Schenectady, NY (US)

( * ) Notice: Subject to any disclaimer, the term of this patent is extended or adjusted under 35 U.S.C. 154(b) by 202 days.

(21) Appl. No.: 14/093,949

(22) Filed: Dec. 2, 2013

(65) Prior Publication Data

US 2014/0151512 A1 Jun. 5, 2014

Related U.S. Application Data

(60) Provisional application No. 61/732,385, filed on Dec. 2, 2012.

(51) Int. Cl.
*B61L 23/04* (2006.01)
*B61L 5/18* (2006.01)

(52) U.S. Cl.
CPC .. *B61L 23/04* (2013.01); *B61L 5/18* (2013.01)

(58) Field of Classification Search
CPC ..... B61L 5/12; B61L 5/18; B61L 5/1854; B61L 23/04
USPC ..... 246/1 C
See application file for complete search history.

(56) References Cited

U.S. PATENT DOCUMENTS

| | | | | |
|---|---|---|---|---|
| 8,924,066 | B2 * | 12/2014 | Fries | B61L 27/0077 246/125 |
| 2008/0007724 | A1 * | 1/2008 | Chung | B61K 9/08 356/237.1 |
| 2009/0105893 | A1 * | 4/2009 | Kernwein | B61L 25/025 701/19 |
| 2010/0063657 | A1 * | 3/2010 | Kumar | B61L 15/0072 701/19 |
| 2010/0258682 | A1 * | 10/2010 | Fries | B61L 3/121 246/1 C |

* cited by examiner

*Primary Examiner* — Zachary Kuhfuss
(74) *Attorney, Agent, or Firm* — GE Global Patent Operation; John A. Kramer

(57) ABSTRACT

An inspection system for use with a rail vehicle includes a sensor configured to be deployed onboard the rail vehicle for inspection of wayside rail equipment to determine operability or alignment of the equipment.

15 Claims, 2 Drawing Sheets

SYSTEM AND METHOD FOR INSPECTION OF WAYSIDE RAIL EQUIPMENT

CROSS REFERENCE TO RELATED APPLICATIONS

This application claims priority to U.S. Provisional application Ser. No. 61/732,385 filed Dec. 2, 2012, hereby incorporated by reference in its entirety.

TECHNICAL FIELD

Embodiments of the invention relate to a system for assessing operability and alignment of wayside rail equipment and associated methods.

BACKGROUND

In the rail industry, maintenance of the railroad track and its components, e.g., fasteners and rail segments, is important as the condition of the track can affect the reliability of rail transportation over the track. It is also important to maintain wayside right of way equipment on the track. For example, a typical right of way includes a crossing gate equipped with lights that signal nearby automobiles when a train is approaching the crossing.

Maintenance of wayside equipment such as the alignment of crossing lights and their operation involves inspection of the equipment, which historically has been accomplished through a visual inspection by a rail worker. Rail workers either perform a visual inspection on foot, which, as will be appreciated, is laborious and inefficient, or from a moving vehicle such as a hi-rail vehicle, typically a passenger automobile outfitted with equipment for running on rails, which is tasked with periodically inspecting both the wayside equipment and rail track as mandated by applicable government regulations.

Modern locomotives are equipped with optical systems mounted in the cab to record a rail engineer's field of vision. These systems, however, are currently not utilized for wayside inspection purposes.

It may be desirable to have a system and method for inspecting wayside equipment that differ from existing systems and methods.

BRIEF DESCRIPTION

In an embodiment, an inspection system for use with a rail vehicle comprises a sensor configured to be operably disposed onboard the rail vehicle for inspection of wayside rail equipment to determine operability and/or alignment of the equipment.

In an embodiment, a method is provided that includes determining an amount of light emitted from an operational and properly aligned wayside signal light and then measuring an amount of light emitted from a wayside signal light along a rail route. The determined and measured amounts of light are then compared to determine if the wayside signal light is operational and properly aligned.

In an embodiment, an inspection system for use with a rail vehicle comprises a reflector configured to be affixed to wayside rail equipment. The reflector can be detected by a sensor mounted to the rail vehicle, and is configured to allow the rail vehicle to inspect the wayside rail equipment to assess alignment and/or operability of the equipment.

In another embodiment, an inspection system comprises a wayside rail equipment having a cowl with a primary light opening and a sensor aperture. The sensor aperture emits light for detection by a sensor mounted to a rail vehicle to allow the rail vehicle to assess alignment and/or operability of the wayside rail equipment.

BRIEF DESCRIPTION OF DRAWINGS

Reference will be made in detail to exemplary embodiments of the invention, examples of which are illustrated in the accompanying drawings. Wherever possible, the same reference numerals used throughout the drawings refer to the same or like parts.

DETAILED DESCRIPTION

Embodiments of the invention relate to a inspection system and method. As used herein, "rail vehicle" can be a locomotive, switcher, shunter, and the like, and includes both freight haulage and passenger locomotives, which themselves may be diesel electric or all electric, and that may run on either AC or DC electric power, and also includes any other vehicles that run on a fixed track, such as rail cars for carrying cargo, ore carts, etc. The term "optical sensors" refers to sensors that employ optics including, but not limited to, laser scanners, still cameras, and video systems. "Wayside equipment" refers to crossing-gates, crossing-gate lights, related right of way equipment, and other rail equipment that is located along side the track.

Figure 1:
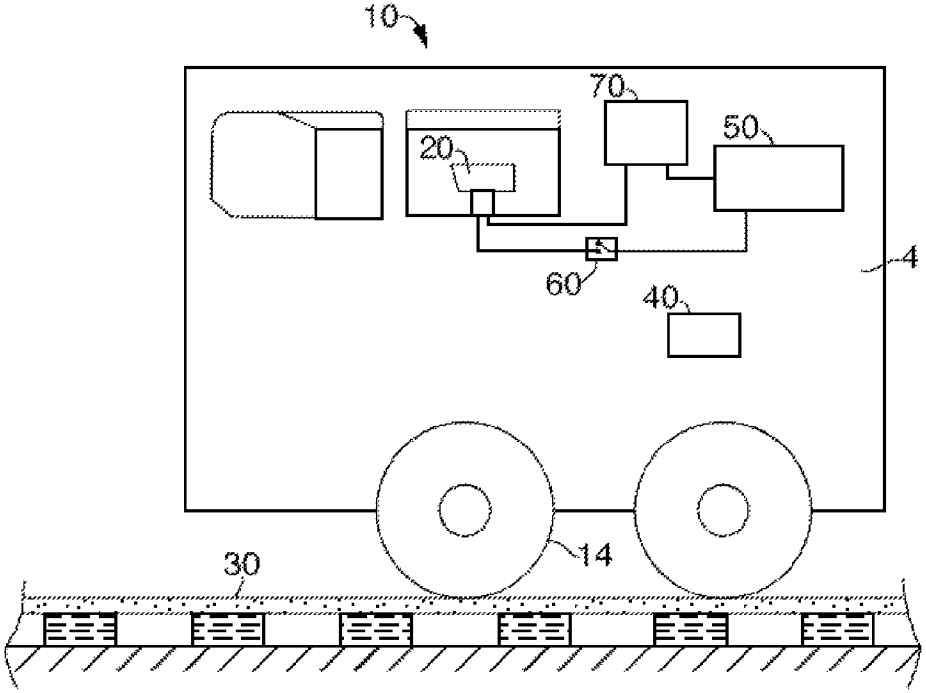
FIG. 1 is a simplified schematic drawing of an inspection system in accordance with an embodiment of the present invention.

In an embodiment, an inspection system 10 is configured for use with a locomotive or other rail vehicle. For example, FIG. 1 shows a simplified schematic diagram of a vehicle, herein depicted as a rail vehicle 4, configured to run on a rail 30 via a plurality of wheels 14. The rail vehicle 4 includes an engine, such as an internal combustion engine. A plurality of traction motors (not shown) are mounted on a truck frame and are each connected to one of the plurality of wheels 14 to provide tractive power to propel and retard the motion of the rail vehicle 4. The traction motors may receive electrical power from a generator/alternator to provide tractive power to the rail vehicle 4.

The inspection system 10 includes a sensor 20 that may include a video camera, a laser scanner, and/or a still camera. The sensor 20 is operatively connected to a controller 50 via a switch 60 and to a location identifying system 40 and an onboard database 70. The database 70 may be stored on a solid-state drive or other mass data storage device.

In an embodiment, the sensor 20 is a video camera. The sensor 20 is shown as being mounted in the cab of the rail vehicle facing forward so that it may capture data from in front of the locomotive. ("Cab" refers to the vehicle enclosure where a human operator can control the vehicle.) As will be appreciated, the sensor 20 may be located on a rotatable and/or movable mount such that the sensor 20 may be rotated about an axis or may be tilted up or down to inspect wayside equipment.

In embodiments, the inspection system 10 is implemented using existing cab video systems configured to capture the engineer's field of vision. The system may also be implemented using a dedicated cab-mounted video system. In other embodiments, it may be possible to mount the sensor 20 outside the cab, such as on the side of the rail vehicle.

As stated, embodiments of the inventive system are configured to inspect the alignment and operability of wayside equipment. These include the proper alignment of crossing signal lights as well as the operability of the signal lights, i.e., whether the bulbs need replacement. "Proper alignment" as used herein refers to crossing signal lights that are oriented toward automobile operators approaching a crossing so that they may be visualized by the same, or that are otherwise oriented towards a designated direction/location where light is to be directed for signaling purposes. Embodiments may also assess the operability of wayside gates, i.e., whether the gate arms raise and lower properly.

Figure 2B:
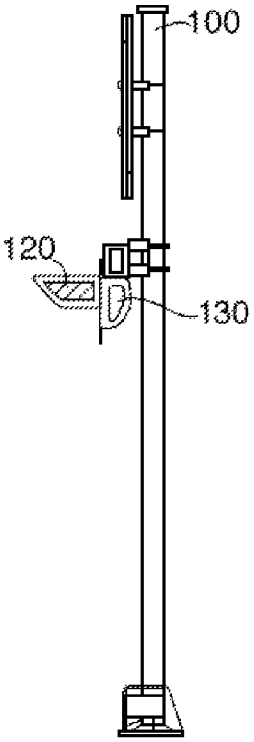
FIG. 2B is a schematic side view of the wayside crossing light of FIG. 2A depicting a reflector in accordance with an embodiment of the present invention, as well as a cowl opening through which a crossing light can be visualized, in accordance with another embodiment.
Figure 2A:
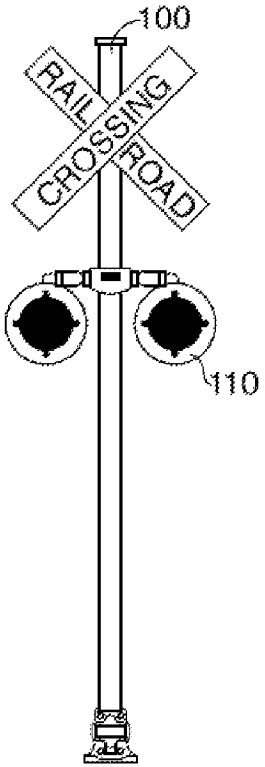
FIG. 2A is a schematic drawing of a post mounted wayside crossing light.

Referring now to FIG. 2B, with respect to crossing signal lights 100, in some embodiments, the sensor 20 may assess the operability and alignment of the light 100 by observing light emitted from an aperture (opening) 130 in the cowl or other housing 110 of the light. The presence or absence of detected light and/or the percentage of light detected relative to a predetermined value when fully aligned can be used to determine the operability and alignment of a light. In an embodiment, the system 10 is configured, e.g., programmed via an algorithm, to detect the emission of red light on a black or other background.

In an embodiment, the aperture 130 in the cowl is aligned with a specific designated field of view, such that the aperture 130 is aligned with the sensor 20 when the vehicle 4 is traveling along a route (e.g., the track 30) and when the crossing signal is properly aligned. The aperture 130 is separate from a main or primary light opening in the cowl of the crossing signal 100 that projects the signal light for the signal's primary purpose as an alert.

In an embodiment, an inspection system comprises a first sensor system configured to be operably disposed onboard a rail vehicle. The first sensor system comprises a sensor that is configured to generate sensor signals indicative of wayside rail equipment inspected by the sensor, and a control module configured to be operably coupled to the sensor and operative to determine at least one of operability or alignment of the wayside rail equipment based on the sensor signals received from the sensor. The first sensor system is a cab-mounted video system, and the sensor of the first sensor system comprises a video camera of the cab-mounted video system. The camera is aligned to view a sensor aperture of the wayside rail equipment when the rail vehicle is traveling along a route. (The wayside rail equipment is disposed on a wayside of the route.) The control module is configured to assess the sensor signals generated by the video camera for determining if the video camera has captured light emitted through the sensor aperture of the wayside rail equipment. The wayside rail equipment is configured to emit signal light along a first axis disposed at a non-zero degree angle to an axis of the sensor aperture. (For example, the wayside rail equipment may be further configured to emit the light through the sensor aperture along the axis of the sensor aperture in a direction of the route when the first axis is aligned generally perpendicular to the direction of the route.)

Figure 3:
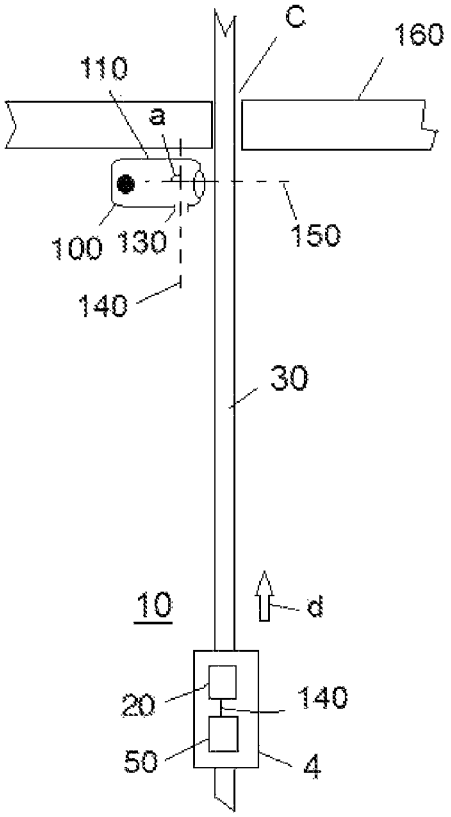
FIG. 3 illustrates another embodiment of an inspection system.

FIG. 3 illustrates an embodiment of the sensor system. As shown therein, an inspection system comprises a first sensor system 10 configured to be operably disposed onboard a rail vehicle 4. The first sensor system comprises a sensor 20 that is configured to generate sensor signals 140 indicative of wayside rail equipment 100 inspected by the sensor, and a control module 50 configured to be operably coupled to the sensor and operative to determine at least one of operability or alignment of the wayside rail equipment 100 based on the sensor signals received from the sensor. The first sensor system 10 is a cab-mounted video system, and the sensor of the first sensor system comprises a video camera of the cab-mounted video system. The camera is aligned to view a sensor aperture 130 of the wayside rail equipment 100 when the rail vehicle is traveling along a route 30. (The wayside rail equipment is disposed on a wayside of the route.) The control module 50 is configured to assess the sensor signals generated by the video camera for determining if the video camera has captured light emitted through the sensor aperture 130 of the wayside rail equipment. The wayside rail equipment 100 is configured to emit signal light along a first axis 150 disposed at a non-zero degree angle "a" relative to an axis 140 of the sensor aperture 130. For example, in an embodiment, the angle "a" is 90 degrees, such that the wayside rail equipment is further configured to emit the light through the sensor aperture along the axis 140 of the sensor aperture 130 in a direction "d" of the route when the first axis 150 is aligned perpendicular to the direction of the route. In other embodiments, the angle "a" is from 45 degrees to 89 degrees, such that the wayside rail equipment is further configured to emit the light through the sensor aperture along the axis 140 of the sensor aperture 130 at a corresponding angle (90-"a") relative to the direction "d" of the route when the first axis 150 is aligned perpendicular to the direction of the route; in such an embodiment, the sensor 20 would be correspondingly aligned towards the corresponding angle, to sense light emitted through the aperture 130 when the rail vehicle passes the corresponding location along the route (that is, the effective intersection of the route and axis 140 of the sensor aperture 130).

In another embodiment of the inspection system, the wayside rail equipment is a wayside crossing signal light located at a crossing "C" of the route 30 and an automobile route 160. The wayside crossing signal light comprises a light cowl 110 that defines the first axis 150 along which the signal light is emitted. The signal light comprises visible light for warning motorists traveling along the automobile route. The sensor aperture 130 comprises a hole in a side of the cowl.

In another embodiment, the wayside crossing signal lights 100 are equipped with reflectors 120 that may be easily detected by the sensor 20. In this embodiment, the sensor can identify if the reflector 120, and attached light, are misaligned if the sensor images or detects less than the entire surface of the reflector 120. That is, if the light is rotated out of alignment, the surface of the reflector 120 will be rotated and partially obscured such that the system 20 will not detect the full reflector. In certain embodiments, the reflector may be configured so that it also reflects light from the light itself such that the operation, in addition to alignment, may be assessed. In other embodiments, operation may be detected through the opening in the cowling 130 and alignment through the reflector 120. As will be appreciated, the reflector 120 may be a flexible reflector with an adhesive backing or it may be affixed by other means or, in certain embodiments, may be integral to the structure of a signal light 100.

Referring back to FIG. 1, the rail vehicle 4 and its sensor 20 are operatively connected to a location identifying system 40, a controller 50 and a database 70. The location identifying system 40 can be a GPS system, or in some instances an RFID system. In any event, the location identifying system 40 may be used to automate the inspection process.

In certain embodiments, the inspection system 10 is configured to automatically inspect wayside crossing equipment. Here, the system includes a controller 50 that utilizes location data from the location identifying system 40, as well as vehicle speed, to activate the sensor 20, via a switch 60, when it is in the appropriate position to inspect wayside equipment. As such, the system need not be continuously running and imaging along an entire rail route.

The system 10 may also be configured to access route information containing locations of specific wayside equipment requiring inspection. This information may be contained in the database 70 or in an off board database (not shown). In particular, the rail vehicle may periodically contact or otherwise connect with the route database to determine whether it is on a route with wayside equipment requiring inspection. The vehicle's location on the route may then be confirmed by the location identifying system 40 (GPS or RFID) and the sensor system 20 can inspect the subject wayside equipment. Operation of the system 10 may be effectuated through software residing on-board the vehicle or off-board.

In another embodiment, the controller 50 may direct a rail vehicle to inspect wayside equipment based on temporal considerations. That is, the database 70 may contain route data along with information regarding the location of wayside equipment, the date of last inspection and the frequency with which inspections should occur for the wayside equipment. When wayside equipment is due for an inspection, the controller 50, utilizing location information, can direct the vehicle to inspect the wayside equipment. The frequency of inspection can be dictated by normal maintenance intervals, regulatory inspection schedules and the like.

In other embodiments, multiple inspection vehicles can inspect a single wayside location to verify status of a piece of equipment.

While in certain embodiments the database may contain route information, the database 50 is also configured to receive data regarding the status of wayside equipment inspected by the sensor system 20. In particular, the system may be configured so that it only sends data to the database indicating misalignment, inoperability or other detected problem with inspected wayside equipment. The system may also be configured so that the database receives an indication of proper operation as well data regarding any detected problems. In any event, the database may be easily accessed, or the data easily and quickly offloaded/transmitted, via a wireless network or the like, so that data regarding any detected problems can be immediately addressed.

Embodiments of the inventive system may be used in connection with other on-board inspection systems such as track inspection systems. In these embodiments, the wayside and track inspection systems may share a controller and a database.

Moreover, the database and controller may be part of a rail vehicle's on-board electronics used to monitor and control traction, engine, and braking systems. These existing electronics often include one or more processors coupled to a mass data storage system via a bus interface. These interconnected components may be stored within the locomotive.

In an embodiment, an inspection system for use with a rail vehicle is provided. The inspection system includes a sensor configured to inspect wayside rail equipment to determine operability or alignment of the equipment.

In an embodiment, a method is provided that includes determining an amount of light emitted from an operational and properly aligned wayside signal light and then measuring an amount of light emitted from a wayside signal light along a rail route. The determined and measured amounts of light are then compared to determine if the wayside signal light is operational and properly aligned.

In an embodiment, an inspection system for use with a rail vehicle is provided. The inspection system includes a reflector configured to be affixed to wayside rail equipment. The reflector can be detected by a sensor mounted to a rail vehicle, and is configured to allow the rail vehicle to inspect the wayside rail equipment to assess alignment or operability of the equipment.

Another embodiment relates to an inspection system comprising a first sensor system configured to be operably disposed onboard a rail vehicle. The first sensor system comprises a sensor that is configured to generate sensor signals indicative of wayside rail equipment inspected by the sensor, and a control module configured to be operably coupled to the sensor and operative to determine at least one of operability or alignment of the wayside rail equipment based on the sensor signals received from the sensor.

In another embodiment, the inspection system further comprises a location identifying system for confirming a location of the rail vehicle relative to a location of wayside rail equipment.

In another embodiment, the inspection system further comprises a second sensor system on board the rail vehicle for inspecting rail track. For example, the second sensor system may be a cab mounted video system.

In another embodiment, the inspection system further comprises a database configured to receive and store at least one of results of wayside rail equipment inspections or locations of wayside rail equipment to be inspected.

In another embodiment of the inspection system, the database includes plural designated values respectively corresponding to plural devices of the wayside rail equipment to be inspected along a route to be traveled by the rail vehicle, each designated value indicative of a determined amount of light emitted from the device corresponding to the designated value when the device is operational and properly aligned. The sensor is configured to generate the sensor signals corresponding to light emitted from the devices and sensed by the sensor as the rail vehicle travels along the route. The control module is configured to perform a comparison of the designated values to the sensor signals and to generate output signals based on the comparison.

Another embodiment relates to a method comprising generating a sensor signal indicative of a sensed amount of light emitted from wayside rail equipment along a rail route, performing a comparison of the sensor signal to a designated value corresponding to a determined amount of light emitted from the wayside rail equipment when the wayside rail equipment is operational and properly aligned, and generating an output signal based on the comparison.

In another embodiment of the method, the steps of generating the sensor signal, performing the comparison, and generating the output signal are performed automatically on board a rail vehicle that passes the wayside rail equipment when traveling along the rail route.

In another embodiment, the method further comprises transmitting the output signal from the rail vehicle to an offboard location. The output signal contains information indicative of: when the comparison indicates that the sensor signal does not match the designated value, the wayside rail equipment being non-operational or misaligned; and when the comparison indicates that the sensor signal matches the designated value, the wayside rail equipment being operational and properly aligned.

In another embodiment of the method, the wayside rail equipment comprises a wayside signal light that emits visible light.

Another embodiment relates to an inspection system comprising a reflector configured to be affixed to wayside rail equipment. The reflector is configured, when affixed to the wayside rail equipment, to be detected by a sensor mounted to a rail vehicle, and is configured to allow the rail vehicle to inspect the wayside rail equipment to assess alignment or operability of the wayside rail equipment.

Another embodiment relates to an inspection system comprising a reflector affixed to wayside rail equipment. The reflector is aligned so as to be detected by a sensor mounted to a rail vehicle, and is configured to allow the rail vehicle to inspect the wayside rail equipment to assess alignment or operability of the wayside rail equipment.

Another embodiment relates to an inspection system that includes wayside rail equipment having a cowl with a primary light opening and a sensor aperture. The sensor aperture emits light for detection by a sensor mounted to a rail vehicle to allow the rail vehicle to assess alignment or operability of the wayside rail equipment.

In another embodiment, a method comprises generating a sensor signal indicative of a sensed amount of light emitted from wayside rail equipment along a rail route. The method further comprises performing a comparison of the sensor signal to a designated value corresponding to a determined amount of light emitted from the wayside rail equipment when the wayside rail equipment is operational and properly aligned. The method further comprises generating an output signal based on the comparison.

In another embodiment of the method, the steps of generating the sensor signal, performing the comparison, and generating the output signal are performed automatically on board a rail vehicle that passes the wayside rail equipment when traveling along the rail route.

In another embodiment of the method, the method further comprises transmitting the output signal from the rail vehicle to an offboard location. The output signal contains information indicative of: when the comparison indicates that the sensor signal does not match the designated value, the wayside rail equipment being non-operational or misaligned; and when the comparison indicates that the sensor signal matches the designated value, the wayside rail equipment being operational and properly aligned.

In another embodiment of the method, the wayside rail equipment comprises a wayside signal light that emits visible light.

The above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. In the claims, the terms "including" and "in which" are used as the plain-English equivalents of the respective terms "comprising" and "wherein." Moreover, in the claims, the terms "first," "second," "third," "upper," "lower," "bottom," "top," etc. are used merely as labels, and are not intended to impose numerical or positional requirements on their objects, unless otherwise stated.

As used herein, an element or step recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

This written description uses examples to disclose several embodiments of the invention, including the best mode, and also to enable one of ordinary skill in the art to practice the embodiments of invention, including making and using any devices or systems and performing any incorporated methods.

What is claimed is:

1. An inspection system, comprising:

a first sensor system configured to be operably disposed onboard a rail vehicle, wherein the first sensor system comprises a sensor that is configured to generate sensor signals indicative of wayside rail equipment inspected by the sensor;

a control module configured to be operably coupled to the sensor and operative to determine at least one of operability or alignment of the wayside rail equipment based on the sensor signals received from the sensor; and a database configured to receive and store at least one of results of wayside rail equipment inspections or locations of wayside rail equipment to be inspected, wherein:

the database includes plural designated values respectively corresponding to plural devices of the wayside rail equipment to be inspected along a route to be traveled by the rail vehicle, each designated value indicative of a determined amount of light emitted from the device corresponding to the designated value when the device is operational and properly aligned;

the sensor is configured to generate the sensor signals corresponding to light emitted from the plural devices of the wayside rail equipment and sensed by the sensor as the rail vehicle travels along the route; and the control module is configured to perform a comparison of the designated values to the sensor signals and to generate output signals based on the comparison.

2. An inspection system, comprising:

a first sensor system configured to be operably disposed onboard a rail vehicle, wherein the first sensor system comprises a sensor that is configured to generate sensor signals indicative of wayside rail equipment inspected by the sensor; and a control module configured to be operably coupled to the sensor and operative to determine at least one of operability or alignment of the wayside rail equipment based on the sensor signals received from the sensor; wherein:

the first sensor system is a cab-mounted video system, the sensor of the first sensor system comprising a video camera of the cab-mounted video system;

the camera is aligned to view a sensor aperture of the wayside rail equipment when the rail vehicle is traveling along a route, the wayside rail equipment being disposed on a wayside of the route; and the control module is configured to assess the sensor signals generated by the video camera for determining if the video camera has captured light emitted through the sensor aperture of the wayside rail equipment, the wayside rail equipment configured to emit signal light along a first axis disposed at a non-zero degree angle relative to an axis of the sensor aperture.

3. The inspection system of claim 2, wherein the wayside rail equipment is further configured to emit the light through the sensor aperture along the axis of the sensor aperture in a direction of the route when the first axis is aligned perpendicular to the direction of the route.

4. The inspection system of claim 2, wherein:

the wayside rail equipment is a wayside crossing signal light located at a crossing of the route and an automobile route;

the wayside crossing signal light comprises a light cowl that defines the first axis along which the signal light is emitted, the signal light comprising visible light for warning motorists traveling along the automobile route; and the sensor aperture comprises a hole in a side of the cowl.

5. An inspection system, comprising:

a reflector configured be affixed to wayside rail equipment;

wherein the reflector is configured, when affixed to the wayside rail equipment, to be detected by a sensor mounted to a rail vehicle, and is configured to allow the rail vehicle to inspect the wayside rail equipment to assess at least one of alignment or operability of the wayside rail equipment.

6. The inspection system claim 5, further comprising:

a database configured to receive and store at least one of results of wayside rail equipment inspections or locations of wayside rail equipment to be inspected.

7. An inspection system, comprising:

wayside rail equipment having a cowl with a primary light opening and a sensor aperture;

wherein the sensor aperture is configured to emit light for detection by a sensor mounted to a rail vehicle to allow the rail vehicle to assess at least one of alignment or operability of the wayside rail equipment.

8. The inspection system of claim 7, wherein the wayside rail equipment is a wayside crossing signal light.

9. The inspection system of claim 7, wherein the sensor aperture comprises a hole in a side of the cowl, a center axis of the hole being generally perpendicular to a center axis of the primary light opening.

10. The inspection system claim 7, further comprising:

a database configured to receive and store at least one of results of wayside rail equipment inspections or locations of wayside rail equipment to be inspected.

11. The inspection system of claim 10, wherein:

the database includes plural designated values respectively corresponding to plural devices of the wayside rail equipment to be inspected along a route to be traveled by the rail vehicle, each designated value indicative of a determined amount of light emitted from the device corresponding to the designated value when the device is operational and properly aligned.

12. The inspection system of claim 7, wherein the wayside rail equipment is a wayside crossing signal light positioned at a crossing of a first vehicle route and a second vehicle route of the rail vehicle, wherein the sensor aperture comprises a hole in a side of the cowl, a center axis of the hole being oriented at an angle to a center axis of the primary light opening, the center axis of the hole being aligned with a designated field of view of the second route of the rail vehicle and the center axis of the primary light opening being oriented towards the first vehicle route.

13. An inspection system, comprising:

a sensor configured to be operably disposed onboard a rail vehicle and to generate sensor signals indicative of wayside rail equipment inspected by the sensor; and a control module configured to be operably coupled to the sensor and operative to determine at least one of operability or alignment of the wayside rail equipment based on the sensor signals; wherein:

the sensor is aligned to view a sensor aperture of the wayside rail equipment when the rail vehicle is traveling along a route, the wayside rail equipment being disposed on a wayside of the route; and the control module is configured to assess the sensor signals for determining if the sensor has captured light emitted through the sensor aperture of the wayside rail equipment, the wayside rail equipment configured to emit signal light along a first axis disposed at a non-zero degree angle relative to an axis of the sensor aperture.

14. An inspection system, comprising:

a sensor configured to be operably disposed onboard a rail vehicle and to generate sensor signals indicative of wayside rail equipment inspected by the sensor; and a control module configured to be operably coupled to the sensor and operative to determine alignment of the wayside rail equipment based on the sensor signals; wherein:

the sensor is aligned to view a reflector affixed to the wayside rail equipment when the rail vehicle is traveling along a route, the wayside rail equipment being disposed on a wayside of the route; and the control module is configured to assess the sensor signals for determining if the sensor has captured light reflected off the reflector, to determine the alignment of the wayside rail equipment.

15. The inspection system of claim 14, wherein the wayside rail equipment includes a primary signal light configured to direct signal light at a non-zero angle to the route of the rail vehicle, the reflector is configured to reflect a portion of the signal light from the primary signal light towards the route of the rail vehicle, and the control module is further configured to assess the sensor signals for determining if the sensor has captured the signal light reflected off the reflector, to determine operability of the wayside rail equipment.

* * * * *